United States Patent [19]

Scheerer

[11] Patent Number: 4,599,302

[45] Date of Patent: Jul. 8, 1986

[54] COLOR PHOTOGRAPHIC RECORDING MATERIAL

[75] Inventor: Rainer Scheerer, Cologne, Fed. Rep. of Germany

[73] Assignee: Agfa-Gevaert Aktiengesellschaft, Leverkusen, Fed. Rep. of Germany

[21] Appl. No.: 736,098

[22] Filed: May 20, 1985

[30] Foreign Application Priority Data

May 30, 1984 [DE] Fed. Rep. of Germany ..... 3420173

[51] Int. Cl.[4] ..... G03C 1/46

[52] U.S. Cl. ..... 430/506; 430/509; 430/567; 430/568

[58] Field of Search ..... 430/509, 506, 571, 567, 430/568

[56] References Cited

U.S. PATENT DOCUMENTS

| | | | |
|---|---|---|---|
| 3,989,527 | 11/1976 | Locker | 430/567 |
| 4,369,248 | 1/1983 | Ranz et al. | 430/376 |
| 4,481,288 | 11/1984 | Yamada et al. | 430/506 |
| 4,513,079 | 4/1985 | Sakanoue et al. | 430/509 |

*Primary Examiner*—Mary F. Downey

*Attorney, Agent, or Firm*—Connolly and Hutz

[57] ABSTRACT

In most highly sensitive recording materials containing silver halide, the graininess may be improved by the addition of a virtually insensitive silver halide-emulsion to a most highly sensitive light-sensitive silver halide emulsion layer.

5 Claims, No Drawings

COLOR PHOTOGRAPHIC RECORDING MATERIAL

This invention relates to a highly sensitive colour photographic recording material containing several silver halide emulsion layers having improved graininess.

For the production of coloured photographic images, it is known to use recording materials carrying a red-sensitive, a green-sensitive and a blue-sensitive silver halide emulsion layer on a layer support, each of the above-mentioned silver halide emulsion layers containing non-diffusible colour couplers for producing, respectively, the cyan, the magenta and the yellow partial colour images produced being in each case complementary to the spectral sensitivity of the silver halide emulsion layer. Conventional colour photographic materials also contain other layers, such as a yellow filter layer between the blue-sensitive silver halide emulsion layer above it and the green-sensitive silver halide emulsion layer below it, as well as an anti-halation layer between the support and the lowermost silver halide emulsion layer. Additional gelatine intermediate layers and a top coat layer may also be provided.

For the production of colour photographic images, it is also known to use recording materials which have at least two silver halide emulsion layers for each of one or more of the three different partial colour images to be produced. Thus, according to GB-PS No. 818,687, the lowermost light-sensitive, colour-producing layer unit of a colour photographic multi-layered material consists of two partial layers containing silver halide and colour coupler which are sensitized to light of the same spectral region, the upper of these two layers having the higher sensitivity, DT-PS No. 1,121,470 discloses the use of such double layers having differing sensitivities of which the more highly sensitive layer produces the lower colour density in colour development.

Colour photographic recording materials having double and triple layers for the different spectral regions are also known from U.S. Pat. Nos. 3,663,228 and 3,849,138. Here again, the upper of the two partial layers sensitive to light of the same spectral region has the higher sensitivity.

A similar arrangement is known from U.S. Defensive Publication T 860,004.

According to DT-OS No. 2,018,341 and U.S. Pat. No. 3,843,369, three silver halide emulsion partial layers having the same spectral sensitivity, but differing in general sensitivity are used in order to improve the graininess of a partial colour image, the more sensitive partial layer being in each case arranged further away from the layer support than any less sensitive partial layer. Furthermore, the maximum colour density obtained in the middle partial layer and in the upper partial layer is at the most 0.6 and the combined maximum colour density of the two layers is at the most 1.0, a result which may be achieved by reducing the coupler content, i.e. by increasing the proportion of silver halide to coupler.

According to DE-OS No. 2,704,826 and U.S. Pat. No. 4,267,264, a colour photographic recording material contains at least three green-sensitive silver halide emulsion partial layers having magenta couplers incorporated therein, each more sensitive partial layer being further removed from the layer support and containing a higher proportion of silver halide to coupler than any less sensitive partial layer. The ratio of sensitivity to graininess is thereby improved.

According to DE-OS No. 2,622,924 and GB-PS No. 1,560,965, at least one additional silver halide emulsion layer containing chloride is arranged within a comparatively highly sensitive emulsion layer unit or immediately adjacent thereto. An increase in sensitivity is thereby achieved.

One unsatisfactory feature of the known measures of obtaining recording materials having maximum sensitivity is that the graininess obtained at the highest sensitivity is too great or, in other words, if the graininess is acceptable, the desired sensitivity is not achieved. Although the graininess could be improved by reducing the amount of coupler used and increasing the amount of silver, such measures would impair the sharpness.

It was therefore an object of the present invention to provide a material having the highest sensitivity combined with improved graininess.

A photographic recording material having at least one blue-, one green- and one red-sensitive layer has now been found, in which at least one layer S is split up into at least three partial layers having differing sensitivities arranged so that the higher the sensitivity of a partial layer, the closer is this layer situated to the object when a photograph is being taken. According to the present invention, the light-sensitive silver halide emulsion layer which is situated closest to the object when a photograph is being taken is a partial layer S 1 of a layer S composed at leaast three partial layers, and it contains in addition a silver halide emulsion U which is virtually insensitive to light.

According to a preferred embodiment, at least the blue-sensitive layer S is composed of these partial layers.

According to another preferred embodiment, the layer S is composed of three partial layers S 1, S 2 and S 3 having diminishing sensitivity.

According to yet another preferred embodiment, the following are applied to a layer support:

at least two red- and two green-sensitive layers having differing sensitivities;

a blue-sensitive layer S composed of at least three partial layers; and a yellow filter layer situated between the blue-sensitive partial layer S 1 and the layer support.

In addition, the conventional intermediate layers, such as anti-halation layers, separation layers, yellow filter layers, hardening layers, etc. may be present.

According to a particularly preferred embodiment, the partial layer S 1 contains a DIR compound.

The light-sensitive silver halide emulsions in the two most highly sensitive partial layers S 1 and S 2 are preferably silver iodobromide emulsions having grain sizes of greater than 0.5 μm and an iodide content of greater than 8 Mol %.

In preferred embodiments, the coupler/silver ratio K/A in the partial layers has the following values:

| Partial layer | K/A [mol/mol] |
|---|---|
| S 1 | from 0.05 to 0.15 |
| S 2 | from 0.05 to 0.15 |
| S 3 | from 0.15 to 0.45. |

By "K" is meant the molar quantity of the colour-producing coupler contained in the particular partial layer, while "A" is the molar quantity of the light-sensitive silver halide present in this partial layer. The molar quantity of the colour-producing coupler should be calculated on the assumption that it is a 4-equivalent coupler. If, for example, a 2- or 6-equivalent coupler is used, the value obtained should be converted accordingly. The term "colour-producing couplers" is restricted in the present case to conventional colour couplers and does not include masking couplers or DIR compounds which undergo a coupling reaction to produce colour.

The maximum colour density of the most highly sensitive partial layer is preferably limited at the same time by applying less silver in this partial layer than in the partial layer having the next highest sensitivity or by using in the most highly sensitive partial layer a slow DIR coupler which influences the colour density without influencing the sensitivity of the developed layer.

In a particular preferred embodiment, the layers indicated below are applied to a layer support (arrangements 1 to 6). In these arrangements, additional layers may be arranged between, above and below the individual layers, especially auxiliary layers, such as anti-halation layers, hardening layers and filter layers:

Layer arrangement

| Arrangements | | | | | |
|---|---|---|---|---|---|
| 1 | 2 | 3 | 4 | 5 | 6 |
| BB | BB | BB | BB | BB | BB |
| B | B | B | B | B | B |
| b | b | RR | RR | RR | b |
| GG | YF | GG | GG | b | YF |
| RR | GG | b | YF | GG | GG |
| YF | RR | YF | b | YF | g |
| G | g | G | G | G | RR |
| g | r | g | g | g | r |
| R | | R | R | R | |
| r | | r | r | r | |

The entries have the following meanings:

| | |
|---|---|
| r | red-sensitive partial layer, low sensitivity |
| R | red-sensitive partial layer, medium sensitivity |
| RR | red-sensitive partial layer, highest sensitivity |
| g | green-sensitive partial layer, low sensitivity |
| G | green-sensitive partial layer, medium sensitivity |
| GG | green-sensitive partial layer, highest sensitivity |
| b | blue-sensitive partial layer, low sensitivity |
| B | blue-sensitive partial layer, medium sensitivity |
| BB | blue-sensitive partial layer, highest sensitivity |
| YF | yellow filter layer |

In layer arrangements 1 to 6, the blue-sensitive partial layers having the highest sensitivity (BB) are in each case provided according to the present invention with a virtually insensitive fine-grained silver halide emulsion.

When a layer is split up according to the present invention into three partial layers, the proportions of the sensitivities of these partial layers cast as single layers are preferably as follows:

| | |
|---|---|
| S 1/S 2 | approximately 1.3 |
| S 2/S 3 | approximately 10. |

These ratios may vary by ±20%. The sensitivity to light of the virtually insensitive emulsion U is preferably less by a factor of from $10^2$ to $10^3$ than the sensitivity to light of the partial layer S 3.

The partial layers S 1 and S 2 may in principle contain the same light-sensitive silver halide emulsion. The higher sensitivity to light of S 1 is obtained by the addition according to the present invention of the insensitive emulsion U.

The virtually insensitive silver halide emulsion U may consist of silver chloride, silver bromide or mixtures thereof. Preferably the grains of this emulsion mainly have a diameter of less than 0.05 μm. In one embodiment, the emulsion U comprises tubular grains. Preferred tubular grains have an aspect ratio of at least 4 and a diameter of less than 0.2 μm. According to a preferred embodiment, the partial layer S 1 contains from 3 to 15 mol % of the insensitive emulsion U, based on the quantity of light-sensitive silver halide emulsion contained in this layer.

In addition to the layers mentioned above, the colour photographic recording material according to the present invention may contain other auxiliary layers which are insensitive to light, e.g. adhesive layers, filter layers, anti-halation layers or covering layers, in particular intermediate layers which are placed between the light-sensitive layers to ensure that diffusion of developer oxidation products from one layer to another will be effectively prevented. Such intermediate layers may also contain, for this purpose, certain compounds which are capable of reacting with the developer oxidation products. Layers of this type are preferably arranged between adjacent light-sensitive layers which differ in spectral sensitivity.

Preferably, colour couplers which react with colour developer oxidation products to form a non-diffusable dye are associated with the light-sensitive silver halide emulsion layers. These colour couplers are advantageously accommodated in a non-diffusible form in the light-sensitive layer or arranged closely adjacent thereto.

Thus, the red-sensitive layer, for example, may contain a non-diffusible colour coupler to produce the cyan partial colour image, generally a coupler of the phenol or α-naphthol series. The green-sensitive layer, for example, may contain at least one non-diffusible colour coupler to produce the magenta partial colour image, a colour coupler of the 5-pyrazolone series being conventionally used for this purpose. The blue-sensitive layer may, for example, contain at least one non-diffusible colour coupler to produce the yellow partial colour image, generally a colour coupler having an open-chain keto-methylene group. The colour couplers may be, for example, 6-, 4- or 2-equivalent couplers. Suitable couplers are known, for example, from the publications "Farbkuppler" by W. Pelz in "Mitteilungen aus den Forschungslaboratorien der Agfa, Leverkusen/München", Volume III, page 111 (1961); K. Venkataraman in "The Chemistry of Synthetic Dyes", Vol. 4, 341 to 387, Academic Press (1971); and T. H. James, "The Theory of the Photographic Process", 4th Edition, pages 353–362; and Research Disclosure No. 17643 of December 1978, Section VII, published by Industrial Opportunities Ltd., Homewell Havant, Hampshire, PO9 1 EF, Great Britain.

The recording material may also contain DIR compounds and so-called "white couplers" which do not give rise to a dye in reaction with colour developer oxidation products. By "DIR compounds" are meant compounds which react with colour developer oxidation products to release diffusible organic compounds which inhibit the development of silver halide. The inhibitors may be split off as such or by way of non-inhibitory intermediate compounds. See GB No. 953,454, U.S. Pat. No. 3,632,345, U.S. Pat. No. 4,248,962 and GB No. 2,072,363.

According to a particularly preferred embodiment, at least two partial layers of a layer sensitive to the same spectral region have DIR compounds of differing reactivities and colour couplers associated therewith. In such an arrangement, the ratio of the effective reaction velocity constants of the colour coupler and of the DIR compound is higher in the more highly sensitive partial layer than in the less sensitive partial layer. The effective reaction velocity constant may be determined electrochemically by methods known from DE-OS No. 2,853,632 and U.S. Pat. No. 4,315,070. The ratio of effective reaction velocity constants in the more sensitive partial layer is preferably from 2:1 to 20:1, while the ratio of reaction velocity constants of colour coupler and DIR compounds in the less sensitive partial layer is preferably from 0.03:1 to 6:1.

The halides used in the light-sensitive silver halide emulsions may be chloride, bromide, iodide or mixtures thereof. According to a preferred embodiment, the halide content of at least one layer is composed of from 0 to 10 mol-% of AgI, from 0 to 50 mol% of AgCl and from 50 to 100% of AgBr, these percentages adding up to 100%.

According to a preferred embodiment, these halides consists predominantly of compact crystals, e.g. having a cubic or octahedral form or transitional forms. They may be characterised by mainly having a thickness of more than 0.2 μm.

The average ratio of diameters to thickness is preferably less than 8:1; diameter of a grain being defined as the diameter of a circle having a surface area equal to that of the projected surface of the grain.

According to another preferred embodiment, all or some of the emulsions may have mainly tabular silver halide crystals in which the ratio of diameter to thickness is greater than 8:1.

The emulsions may be chemically sensitized. The conventional sensitizing agents are suitable for chemical sensitization of the silver halide grains. Compounds containing sulphur are particularly preferred, e.g. allyl isothiocyanate, allyl thiourea and thiosulphates. The chemical sensitizers used may also be reducing agents, e.g. the tin compounds described in Belgian Pat. Nos. 493,464 and 568,687, or polyamines, such as diethylene triamine or aminomethyl-sulphinic acid derivatives, e.g. according to Belgian Pat. No. 547,323. Noble metals, such as gold, platinum, palladium, iridium, ruthenium or rhodium, and compounds of these metals are also suitable chemical sensitizers. This method of chemical sensitization has been described in the article by R. Koslowsky, Z. Wiss Phot. 46, 65–72, (1951). The emulsions may also be sensitized using polyalkylene oxide derivatives, e.g. a polyethylene oxide having a molecular weight of from 1000 to 20,000, or using condensation products of alkylene oxides and aliphatic alcohols, glycols, cyclic dehydration products of hexitols, using alkyl substituted phenols, aliphatic carboxylic acids, aliphatic amines, aliphatic diamines and amides. These sensitizers may, of course, be combined to produce particular effects, as described in Belgian Pat. No. 537,278 and British Pat. No. 727,982. See also the above-mentioned Research Disclosure No. 17643, Section III.

The emulsions may be optically sensitized in known manner, e.g. using the conventional polymethine dyes, such as neutrocyanines, basic or acid carbocyanines, rhodacyanines, hemicyanines, styryl dyes, oxonols and the like. Sensitizers of this type have been described by F. M. Hamer in "The Cyanine Dyes and Related Compounds" (1964). See also in particular Ullmans Enzyklopädie der et seq., and the above-mentioned Research Disclosure No. 17643, Section IV.

The conventional antifogging agents and stabilizers may be used. Azaindenes are particularly suitable stabilizers, especially the tetra- and penta-azaindenes, in particular those which are substituted with hydroxyl or amino groups. Compounds of this type are described, for example, in the article by Birr, Z. Wiss Phot. 47, (1952), pages 2–58. Other suitable stabilizers and antifogging agents are mentioned in the above Research Disclosure No. 17643, Section IV.

The components of the photographic material may be incorporated by conventional methods. If they are water-soluble or alkali-soluble compounds, they may be added in the form of aqueous solutions, optionally with the addition of water-miscible organic solvents, such as ethanol, acetone or dimethylformamide. If they are insoluble in water and alkalies, they may be incorporated in the recording material in a dispersed form in known manner. For example, a solution of these compounds in a low-boiling organic solvent may be mixed directly with the silver halide emulsion or it may first be mixed with an aqueous gelatine solution from which the organic solvent is subsequently removed and the resulting dispersion of the particular compound may then be mixed with the silver halide emulsion. So-called "oil-formers" may also be added. These are generally relatively high-boiling organic compounds in which the compounds to be dispersed are occluded in the form of oily droplets. See in this connection, for example, U.S. Pat. Nos. 2,322,027; 2,533,514, 3,689,271; 3,764,336 and 3,765,897. Components of the photographic material, e.g. couplers and UV absorbents; may also be incorporated in the form of charged latices, see DE-OS No. 2,541,274 and EP-A No. 14 921. The components may also be fixed in the material in the form of polymers, see e.g. DE-OS No. 2,044,992, U.S. Pat. No. 3,370,952 and U.S. Pat. No. 4,080,211.

The conventional layer supports may be used for the materials according to the present invention, e.g. supports of cellulose esters, such as cellulose acetate and of polyesters. Paper supports are also suitable, optionally coated, e.g. with polyolefins, in particular with polyethylene or polypropylene. See in this connection the above-mentioned Research Disclosure No. 17643, Section XVIII.

The conventional hydrophilic film-forming agents may be used as protective colloids or binders for the layers of the recording material, e.g. proteins, in particular gelatine, alginic acid or derivatives thereof, such as esters, amides or salts, cellulose derivatives, such as carboxymethyl cellulose or cellulose sulphates, starches or derivatives thereof, or hydrophilic synthetic binders, such as polyvinyl alcohol, partially saponified polyvinyl acetate, polyvinyl pyrrolidone, etc. The hydrophilic binders in the layers may also be mixed with other synthetic binders present as solutions or dispersions, such as homo- or co-polymers of acrylic or methacrylic acids or derivatives thereof, such as esters, amides or nitriles, or vinyl polymers, such as vinyl esters or vinyl ethers. See also the binders mentioned in the above Research Disclosure 17643, Section IX.

The layers of the photographic material may be hardened in the conventional manner, for example using epoxide-type hardeners or hardeners of the type of heterocyclic ethylene imine or of acryloyl. The layers may also be hardened by the process according to German Offenlegungsschrift No. 2,218,009 to produce colour photographic materials which are suitable for high temperature processing. The photographic layers or colour photographic multilayered materials may also be hardened using hardeners of the diazine, triazine, or 1,2-dihydroquinoline series or using vinyl sulphone-type hardeners. Other suitable hardeners are known from German Offenlegungsschrift Nos. 2,439,551, 2,225,230 and 2,317,672 and from the above-mentioned Research Disclosure 17643, Section XI.

Other suitable additives are indicated in Research Disclosure 17643 and in "Product Licensing Index" of December 1971, pages 107–110.

Suitable colour developer substances for the material according to the present invention include in particular those of the p-phenylene diamine series, e.g. 4-amino-N,N-diethylaniline hydrochloride; 4-amino-3-methyl-N-ethyl-N-β-(methane-sulphonamido)-ethylaniline sulphate hydrate; 4-amino-3-methyl-N-ethyl-N-β-hydroxyethylaniline sulphate; 4-amino-N-ethyl-N-(2-methoxyethyl)-m-toluidine-di-p-toluene sulphonic acid and N-ethyl-N-β-hydroxyethyl--phenylene diamine. Other suitable colour developers have been described, for example, in J. Amer. Chem. Soc. 73, 3100 (1951); and in G. Haist, Modern Photograhic Processing, 1979, John Wiley and Sons, New York, pages 545 et seq.

After colour development, the material is normally bleached and fixed. Bleaching and fixing may be carried out separately or together. The conventional compounds may be used as bleaching agents, e.g. $Fe^{3+}$ salts and $Fe^{3+}$ complex salts, such as ferricyanides, dichromates, water-soluble cobalt complexes, etc. Iron-III complexes of aminopolycarboxylic acids are particularly preferred, especially, for example, ethylene diaminotetracetic acid, nitrilotriacetic acid, iminodiacetic acid, N-hydroxyethylethylene diaminotriacetic acid, alkyliminodicarboxylic acid and corresponding phosphonic acids. Persulphates are also suitable bleaching agents.

EXAMPLES

In the Examples which follow, the couplers used are identified by the following symbols;

| No. | Compound |
|---|---|
| Bg 1 | 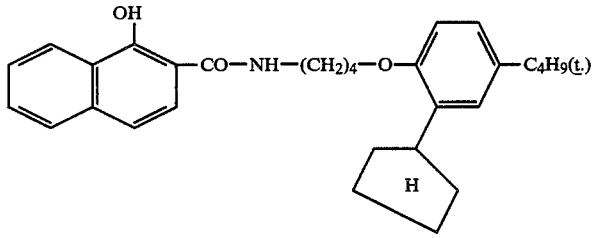 |
| Pp 1 | 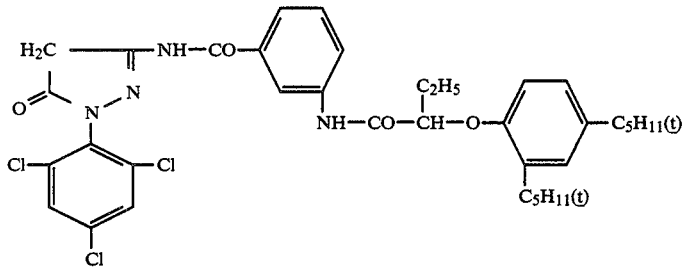 |

-continued
| No. | Compound |
|---|---|
| Gb 1 | 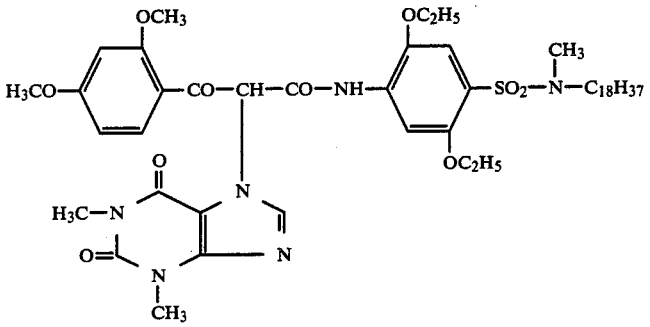 |
| Gb 2 | 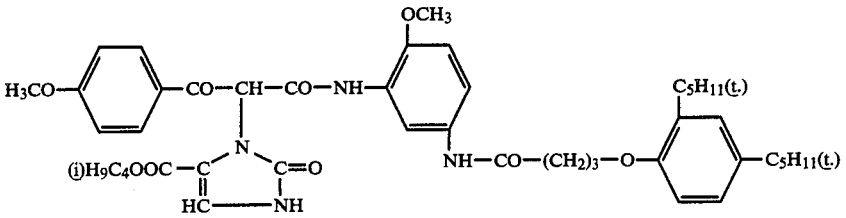 |
| DIR 1 | 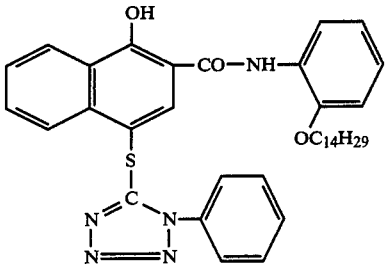 |
| DIR 2 | 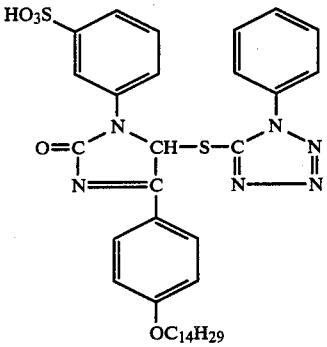 |
| DIR 3 | 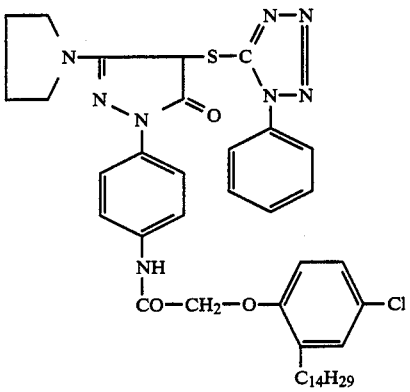 |

-continued

| No. | Compound |
|---|---|
| M 1 | 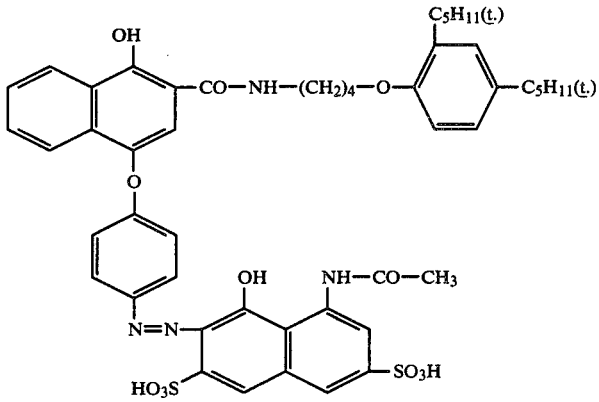 |
| M 2 | 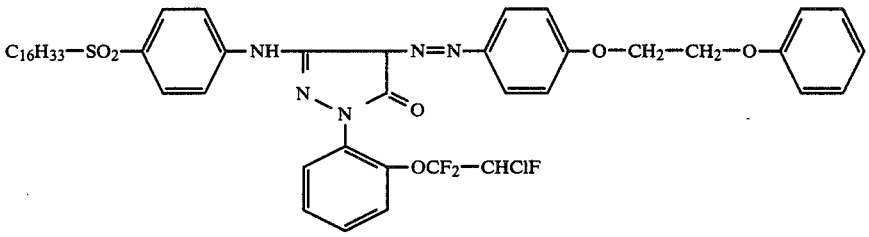 |

The following layers are first applied to a layer support. The amounts are given per $m^2$, the quantities of silver halide application being converted to silver nitrate. The green-sensitive and red-sensitive layers are spectrally sensitized in known manner.

| No. | Sensitivity | Composition (quantities/$m^2$) |
|---|---|---|
| 9 | b | 900 mg of a silver bromide emulsion containing 400 mg of each of the yellow couplers Gb 1 and Gb 2 |
| 8 | — | Yellow filter layer (D = 0.5) |
| 7 | — | Protective layer |
| 6 | GG | 3400 mg of a silver iodobromide emulsion + 510 mg of coupler Pp 1 + 50 mg of masking coupler M 2 + 50 mg of DIR coupler DIR 2 |
| 5 | g | 1400 mg of a silver iodobromide emulsion + 420 mg of coupler Pp 1 + 50 mg of coupler M 2 + 25 mg of DIR coupler DIR 3 |
| 4 | — | Protective layer |
| 3 | RR | 4400 mg of a silver iodobromide emulsion + 260 mg of coupler Bg 1 + 60 mg of DIR coupler DIR 2 |
| 2 | r | 3700 mg of a silver iodobromide emulsion + 670 mg of coupler Bg 1 + 80 mg of masking coupler M 1 + 30 mg of DIR coupler DIR 1 |
| 1 | — | Protective layer |

Layer Support

The following layers are additionally applied to this arrangement:

| Example | Layer No. | Sensitivity | (Composition (quantities/$m^2$) (D = average grain diameter) |
|---|---|---|---|
| 1 (Comparison) | 10 | B | 1400 mg of AgBrI emulsion (D = 0.75 μm) + 250 mg of coupler Gb 1 + 250 mg of coupler Gb 2 |
| 2 (Comparison) | 10 | B | as in Example 1, layer 10 with D = 0.95 μm |
| 3 (Comparison) | 10 | B | as in Example 1, layer 10, but in addition 100 mg of an insensitive emulsion U of AgBr (D 0.05 μm) |
| 4 (Invention) | 10 | B | Layer No. 10 as in Example 1, but only half the quantity of emulsion and coupler. |
| | 11 | BB | same as layer 10, but in addition 50 mg of emulsion U from Example 3 |
| 5 (Comparison) | 10 | B | same as Example 4, layer 10 |
| | 11 | BB | same as Example 2, layer 10, but only |

-continued

| |
|---|
| half the quantity of emulsion and coupler |

The abbreviations entered in the column headed "Sensitivity" have the meanings given above. The column headed "Composition" indicates the silver halide and colour-producing couplers, but not other constituents (e.g. gelatine).

The material is image-wise exposed and subjected to the colour negative development process disclosed in "British Journal of Photographic Annual" 1979, page 204.

The layer arrangements all have substantially the same gradation, but different results as regards sensitivity and graininess are obtained. The graininess was measured behind a blue filter, using a red shutter 29 μm in diameter, and given a $\delta_D$-value. For explanations, see Ullmanns Encyclopädie der technischem Chemie, 4th Edition, Verlag Chemie, 1979, page 413. The following results are obtained:

| Example No. | Sensitivity | $\sigma_D$-value D = 1.0 | $\sigma_D$-value D = 1.5 |
|---|---|---|---|
| 1 (comparison) | 100 | $5.2 \cdot 10^{-2}$ | $4.7 \cdot 10^{-2}$ |
| 2 (comparison) | 150 | $5.8 \cdot 10^{-2}$ | $5.2 \cdot 10^{-2}$ |
| 3 (comparison) | 126 | $5.8 \cdot 10^{-2}$ | $5.3 \cdot 10^{-2}$ |
| 4 (invention) | 142 | $5.5 \cdot 10^{-2}$ | $4.4 \cdot 10^{-2}$ |
| 5 (comparison) | 132 | $5.7 \cdot 10^{-2}$ | $5.2 \cdot 10^{-2}$ |

Arrangement No. 4 according to the present invention shows an unexpected improvement in the sensitivity/graininess ratio. According to the present invention, therefore, the sensitivity at a given graininess is improved and the graininess at a given sensitivity is improved.

I claim:

1. Photographic recording material having at least one green-, and one red-sensitive layer, and at least one blue-sensitive layer S which is split up into at least three partial layers having differing sensitivities arranged so that the higher the sensitivity of a partial layer, the closer is this partial layer arranged to the object when a photograph is being taken, wherein the light-sensitive silver halide emulsion layer which is situated closest to the object when a photograph is being taken, is a partial layer S 1 of layer S and a silver halide emulsion U which is virtually insensitive to light the grains of which mainly have a diameter less than 0.05 μm is contained in the partial layer S 1.

2. Photographic recording material according to claim 1, wherein the layer S is composed of three partial layers.

3. Photographic recording material according to claim 1, wherein the following are applied to a layer support at least two red-sensitive and two green-sensitive partial layers having differing sensitivities;

a blue-sensitive layer S composed of at least three partial layers; and a yellow filter layer situated between the blue-sensitive partial layer S 1 and the layer support.

4. Photographic recording material according to claim 1, wherein the partial layer S 1 contains a DIR compound.

5. Photographic recording material according to claim 1, wherein the two most highly sensitive partial layers of layer S contain a silver iodobromide emulsion having a grain size of greater than 0.5 μm and an iodide content of greater than 8 mol-%.

* * * * *